US005771923A

United States Patent [19]

Paterson et al.

[11] Patent Number: 5,771,923

[45] Date of Patent: Jun. 30, 1998

[54] GASKETING AND BLEED MEANS FOR AN ELECTRICALLY CONTROLLED FAUCET ASSEMBLY

[75] Inventors: Graham H. Paterson; Willard A. Denham, both of Wilmington, Del.

[73] Assignee: Speakman Company, Wilmington, Del.

[21] Appl. No.: 635,501

[22] Filed: Apr. 22, 1996

[51] Int. Cl.[6] ..... F16K 31/14

[52] U.S. Cl. ..... 137/513.5; 251/129.04

[58] Field of Search ..... 137/513.5, 599; 251/129.04; 4/623

[56] References Cited

U.S. PATENT DOCUMENTS

| | | | |
|---|---|---|---|
| 3,727,635 | 4/1973 | Todd | 137/513.5 |
| 3,904,167 | 9/1975 | Touch et al. | 251/129.04 |
| 4,872,476 | 10/1989 | Pflum | 137/513.5 |
| 5,095,941 | 3/1992 | Betz | 251/295 |

*Primary Examiner*—Marguerite McMahon
*Attorney, Agent, or Firm*—Connolly & Hutz

[57] ABSTRACT

An electrically controlled faucet is disclosed which is operable by pushing a button or placing hands within the operating range of a sensor. The faucet is mounted to a sink deck or like surface using specially configured gasket means which insure against slippage of the faucet on the deck. The gasketing means provide special channels through which electrical operating wires can be securely passed from the faucet to operating means below the sink deck. These operating means include a solenoid valve that controls fluid flow through the faucet and a temperature control valve fluidly linked to the solenoid valve. Solenoid disabling pressure buildup in the line linking the temperature control valve and solenoid is bled through special bleed means in the temperature control valve inlets.

5 Claims, 3 Drawing Sheets

GASKETING AND BLEED MEANS FOR AN ELECTRICALLY CONTROLLED FAUCET ASSEMBLY

FIELD OF THE INVENTION

This invention relates to the field of liquid metering faucets. Specifically, this invention relates to an automatic faucet with improved gasketing and high pressure bleed means.

BACKGROUND OF THE INVENTION

Convenience, economy, and safety are major concerns to be addressed when contemplating construction of any kind. One of the most often used areas in a structure and one of the most sensitive to those factors is the rest room facility. The present invention relates to a novel metering faucet assembly which is efficient, one-touch, and inexpensive.

DESCRIPTION OF THE PRIOR ART

Personal hygiene in today's crowded environment is a must. Other than a shower or tub, the sink is perhaps the most common means for performing personal ablutions. It is certainly one of the most frequently used.

Sinks pose a series of problems in this regard. In a crowded office or institution literally hundreds of persons may utilize a sink, which naturally includes touching the faucet, sometimes with wet hands. A faucet which remains wet all day long can be a fertile environment for the growth of microorganisms and consequently enhance the spread of disease.

The prior art is replete with faucets, too many to mention here. The original faucet assembly comprised a single handle over a spout. Rotating the handle counterclockwise opened the water conduit by releasing a sealing gasket or threaded plunger. The water fed to the faucet under pressure, emerged in a stream from the spout. Turning the handle counterclockwise resulted in a re-engagement of the gasket or plunger. The original faucet was fed by a single cold water source.

As hot water entered common use with the advent of boilers, a second faucet was supplied for hot water. To obtain water of varying temperature, a connection between the outflow spouts was made, allowing for independent adjustment. Thus was developed the modern convenience faucet.

As the need to conserve water, especially in crowded urban environments, increased electronically controlled sensor activated valves were introduced. In these devices a sensor is focused in the sink area, and when hands are passed under the spout, the valve opens to allow water to flow out of the spout. When the hands are removed, the flow ceases.

However, these sensor devices are complex, and are frequently temperamental and balky. Due to the variations present in the human form and the sink configuration, difficulties in triggering the water flow are often experienced with sensors. The sensors also usurps the users' options as to when and how much water flow is desired.

Another problem with sensor operated faucet stems from their interconnection with solenoid operated valving mechanisms, for example, the diaphragm valving described in U.S. Pat. No. 4,948,090. Pressure buildup on one side of the diaphragm can render such valves inoperable.

U.S. Pat. No. 4,953,236 illustrates an automatic mixing faucet, and its disclosure is incorporated herein by reference. A sensor (infrared detector) detects the presence of an object within the faucet region, and sends a signal which operates a motor which controls a valve to allow for the flow of water. All of the detection apparatus and operational components are housed within the faucet.

A faucet assembly for aircraft utilizing push button operation of a solenoid valve is disclosed in U.S. Pat. No. 4,884,725.

SUMMARY OF THE INVENTION

Applicant has developed a novel faucet assembly which is inexpensive, reliable, sanitary, and avoids the drawbacks above of the prior art.

The faucet assembly of this invention comprises parts both seen and unseen by the user. Above the countertop or sink deck 12 the faucet assembly of this invention typically comprises a faucet housing 10 with push-button 22 conveniently mounted to be readily seen by the user. FIG. 7 illustrates other components of the push-button faucet assembly seen by the faucet user, including a bypass valve 92 and rotary temperature selection handle 102. Like arrangements for sensor operated faucet assemblies are illustrated in FIGS. 8 and 9. In these embodiments flow through faucet 10 is controlled by a sensor 23 in a manner known in the art.

As best illustrated in FIGS. 7–9, below the countertop or sink deck 12 the faucet assembly of this invention includes (in the same order as water flows through the assembly) a temperature control valve 100 with hot and cold water inlets 104, 106 and outlets 108 and 110. This valve 100 controls the temperature of water exiting the faucet 10 by mixing hot and cold water from inlets 104 and 106.

The tempered water normally exits mixing valve 100 via outlet 108 and is conveyed by pipe or tubing 112 to an electronically operated solenoid valve 120 which controls flow of the tempered water to and through faucet 10 in response to signals from push buttons or sensors associated therewith. Bypass valve 90 provides and alternate flow path for tempered water exiting mixing valve 100. Bypass valve 90 is utilized to bypass solenoid valve 120 in the event there is an electrical or other failure that prevents operation of the solenoid valve 120. In that event a simple turn of handle 92 allows the flow of tempered water to exit mixing valve 100 at outlet 110 and flow through tubing or piping 113, 118 and 122 directly to and through faucet 10. Alternatively, flow to bypass valve can be tapped off line 112 rather than through outlet 110 and/or the outlet 92 of bypass valve 90 can be piped directly to faucet 10 through supply line 122. A further turn of the handle 92 manually shuts off flow of water through the faucet 10.

One of the reasons why the solenoid valve 120 might fail is excess pressure buildup in the line 112 between mixing valve 100 and solenoid valve 120. Such pressure buildup can occur when water hammer in inlets 104 and/or 106 occurs while the solenoid valve 120 is closed. That pressure buildup is maintained in line 112 because the inlets 104 and 106 typically contain check valves that prevent release of pressure once the water hammer or other increased pressure condition inside mixing valve 100 or piping 112 subsides. The excess pressure exerted on solenoid valve 120 precludes its operation. More particularly, the solenoid valve 120 utilizes a diaphragm type valve of the type disclosed in U.S. Pat. No. 4,948,090. In such a valve extremely high pressure on one side of the diaphragm can prevent operation of the solenoid plunger that allows equalization of pressure across the diaphragm and movement thereof to open full flow of water through the valve. For example, in FIG. 2 of U.S. Pat.

No. 4,948,090 a solenoid valve is illustrated in which excess pressure in the area to the left of the plunger (valve stem) can prevent its electromagnetic retraction. In other words, the electromagnet is not strong enough to overcome the water pressure acting to keep the plunger in sealing engagement with the water outlet in the diaphragm (reference numeral 135 in FIG. 2 of U.S. Pat. No. 4,948,080).

To prevent this high pressure shutdown of the solenoid valve 120 applicant has introduced a simple, but effective, pressure release means in inlets 104 or 106. As best illustrated in FIG. 15, cold water inlet 106 contains a V-shaped groove 145 scored in the internal diameter thereof. This groove 145 interconnects the areas above and below check valve means 140 in the inlet so that any pressure buildup in the area 142 above the check valve can be bled out through groove 130 to the other side 144 of the check valve 140. This very simple, but effective, bleed means prevents disabling pressure buildup in the solenoid valve 120.

The faucet 10 used in applicants faucet assembly comprises a spout from which water emerges, a faucet shroud which encloses the spout 16, a unique upper sealing gasket 70 for securely mounting the faucet and shroud to the sink deck, a water supply nipple 18 which extends downwardly through the sink deck to supply water to and anchor the faucet, a lower sealing gasket 36, and tightening and securing device. The faucet also contains an integrally molded touch-sensitive membrane-type switch 22 and associated wiring connected to the solenoid valve 120 to control the flow of water through the faucet. Alternatively, such flow can be controlled by a sensor.

The invention is best understood by reference to the drawings.

DETAILED DESCRIPTION

Simply put, faucets take a lot of physical stress. They are scoured, soaked, and subjected to water of all temperatures. They are knocked about and generally mishandled during their service life and during installation, servicing, and adjustment can be damaged. Thus, a faucet needs to be stable, firmly anchored, durable, and simple. The instant invention provides those qualities and more.

Figure 1:
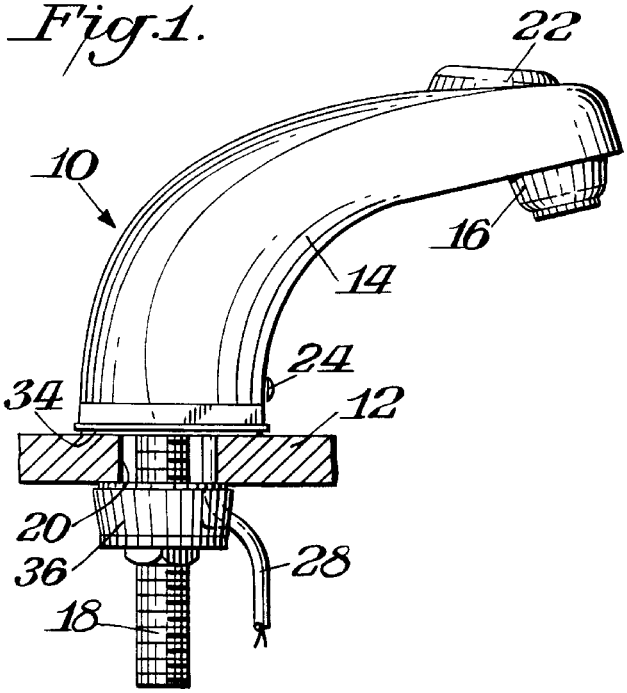
FIG. 1 is a view in side elevation of a push button faucet according to the present invention.

As may be seen by reference to FIG. 1, the faucet is elegant and simple in design. A single assembly 10 protrudes from the sink deck 12, leaving little to be manhandled or damaged. The external surface of the faucet is shroud 14, which may be a separate piece from the internal water conduit through the shroud, or integrally molded to the water conduit. Water emerges from the spout at optional aerator assembly 16. The faucet 10 is affixed to the sink deck 12 by means of a nut 44 rotatably affixed to the threaded outer surface the water supply nipple 18. The sink deck 12 is formed with a corresponding nipple access hole 20.

Water is supplied to the faucet from a water source (not shown) which may be cold, hot, or premixed to a set temperature by the temperature control valve 100. Water flow through faucet 10 is controlled by solenoid valve 120.

Initiation of water flow is enabled by membrane switch 22 which is a single touch-sensitive switch which acts to either close or open a circuit to solenoid 120. This causes the water to flow up the conduit and out through the spout and aerator 16.

The flow may be regulated by a timing device to allow flow for a set amount of time, a flow meter to allow a specified amount of fluid to be dispensed, or the flow may be entirely unmetered, allowing water to flow until the switch is pressed again to close the valve. Optional indicator light 24 may indicate circuit operation, battery level, flow state, or any number of conditions by appropriate arrangement.

The power supply to drive the switch and valve assembly may be derived from battery sources, in which case indicator light 24 would serve to indicate a low voltage/battery level. Or, the power supply could be derived from the household current through a transformer, if necessary.

Figure 2:
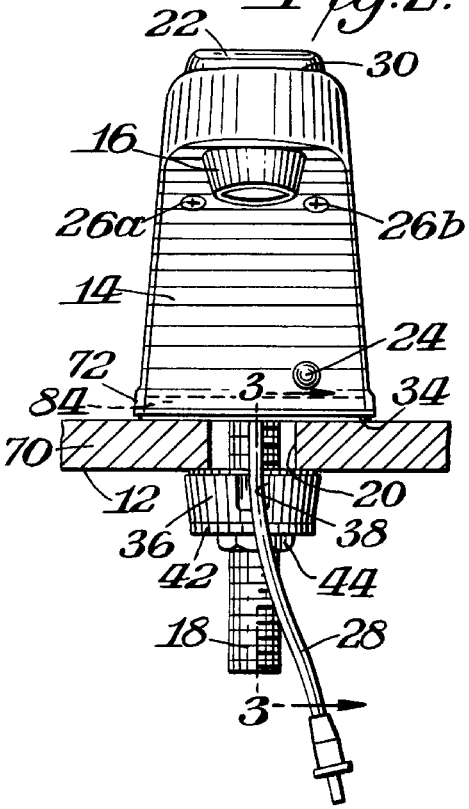
FIG. 2 is a view in front elevation of a push button faucet according to the present invention.

FIG. 2 illustrates a front view of the faucet of this invention. In this view, the shroud is clearly seen as two pieces, joined by screws 26*a* and 26*b*. Control wire 28 leads from the membrane switch 22 which is set into a raised portion 30 of the shroud 14. In another embodiment of the faucet assembly this wire 28 would lead from a sensor arranged under the spout to sense the user's body as discussed above.

The faucet is securely mounted to the sink deck 12 by means of upper sealing gasket 34 and lower sealing gasket 36. Lower sealing gasket 36 is formed with recess or cutout 38 which forms a protective passage for control wire 28 through the nipple access hole 20. Washer 42 engages lower sealing gasket 36 when nut 44 is tightened. Nut 44 is in threaded engagement with water supply nipple 18. This method of anchoring the faucet provides exceptional stability and strength while providing protection for passage of electrical wire 28 through the deck 12, as illustrated in FIGS. 3–6.

Figure 3:
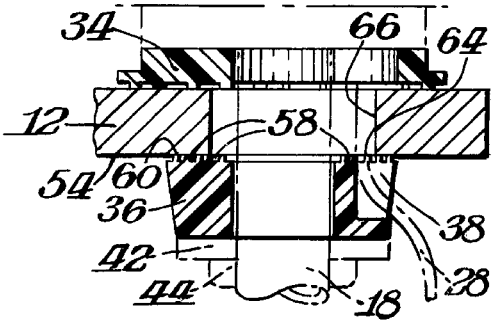
FIG. 3 is a partial view in cross section of the sink-faucet mounting interface taken along line 3—3 of FIG. 2.

FIG. 3 illustrates an enlarged partial view of these faucet anchoring gaskets and their interaction. Nut 44 provides engaging force directed upwards against washer 42. Washer 42 provides lateral and torsional stability to lower sealing gasket 36. Lower sealing gasket 36 provides an exceptional grip to the lower surface 54 of sink deck 12 by virtue of concentric grooves 58 and concentric ridges 60 formed in the top surface of lower sealing gasket 36.

Figure 4:
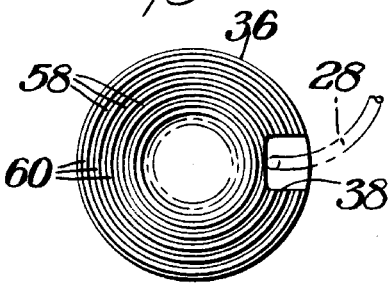
FIG. 4 is a top plan view of the lower sealing gasket of the present invention.

These grooves 58 are more clearly seen in FIG. 4. FIG. 4 also illustrates the recess 38 formed in the lower sealing gasket 36, through which control wire 28 passes.

Returning to FIG. 3 briefly, it may be seen that the recess 38 is just deep enough to provide gap 64 between supply nipple 18 and deck access hole wall 66, but not deep enough to adversely affect the secure mounting of the faucet. This arrangement provides a secure smooth area through which control wire 28 can pass without fraying due to contact with surrounding structure, including the supply nipple 18. The grooves 60 in the upper surface of lower gasket 36 act to secure the bond between the gasket 36 and deck 12.

Figure 5:
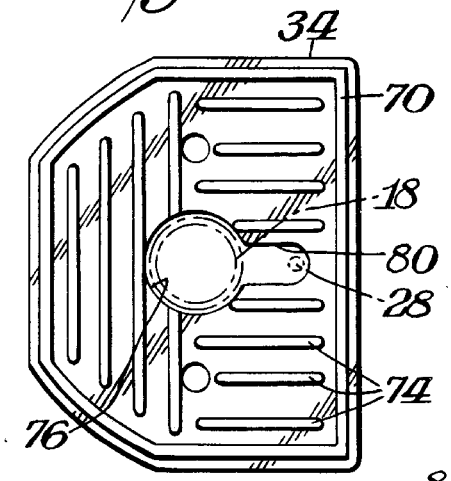
FIG. 5 is a bottom plan view of the upper sealing gasket of the faucet of the instant invention.
Figure 6:
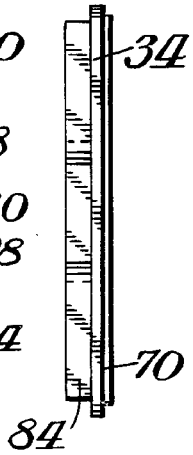
FIG. 6 is a view in side elevation of the upper sealing gasket according to the instant invention.

FIGS. 5 and 6 illustrate the upper sealing gasket 34. It is formed so as to be shaped the same as the bottom of the faucet shroud at the point where it meets the deck and may be of any shape. The upper sealing gasket 34 may be formed with lip 70 which runs around the perimeter of the gasket. This lip fits in snugly underneath the shroud edge 72, which is visible in FIG. 2. This snug fit provides further stability and seals against water intrusion. Ridges 74 on the bottom of gasket 34 provide a positive mechanical joint with the sink deck 12, and inhibit slippage. Nipple access hole 76 allows nipple 18 to pass through the upper sealing gasket 34. Control wire access hole 80 allows the control wire 28 to pass through the upper sealing gasket 34.

FIG. 6 illustrates the height of the lip 70 and ridges 74 on the lower side of the upper sealing gasket 34. On the top side of the upper sealing gasket are supports 84. The supports are aligned underneath the structural elements of the faucet and provide additional support underneath the shroud edge for previously unattainable stability.

Applicant's upper and lower gaskets differ from typical gasketing used in similar faucets in that it ensures secure attachment of the faucet 10 to the sink deck 12 while providing protection for associated control lines 28 passing out of the faucet. Other faucet gaskets disclosed in the art are typically flat (see reference numeral 35 in U.S. Pat. No. 4,804,010) or use elaborate O-ring type gasketing between parts (see reference numeral 16 in U.S. Pat. No. 4,513,769).

Figure 7:
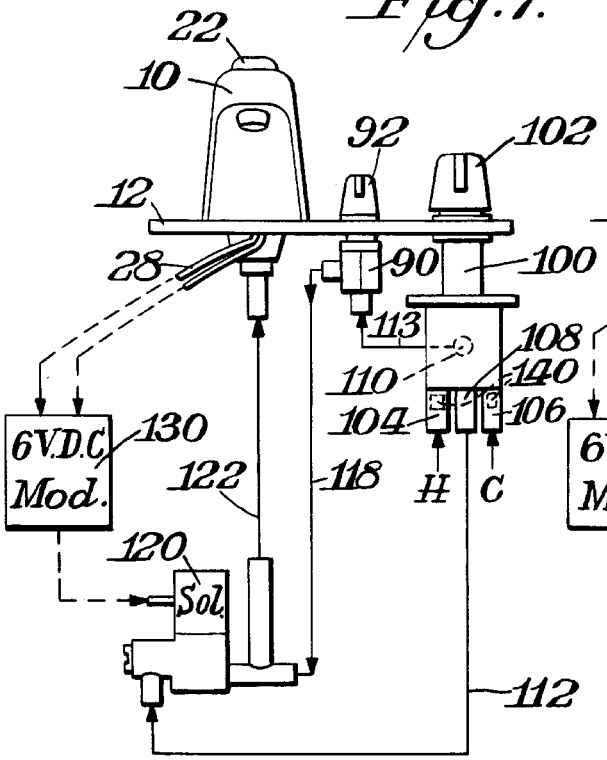
FIG. 7 is a schematic of one embodiment of the faucet assembly of this invention utilizing a push button and bypass valve to electrically and manually control flow through the faucet.
Figure 8:
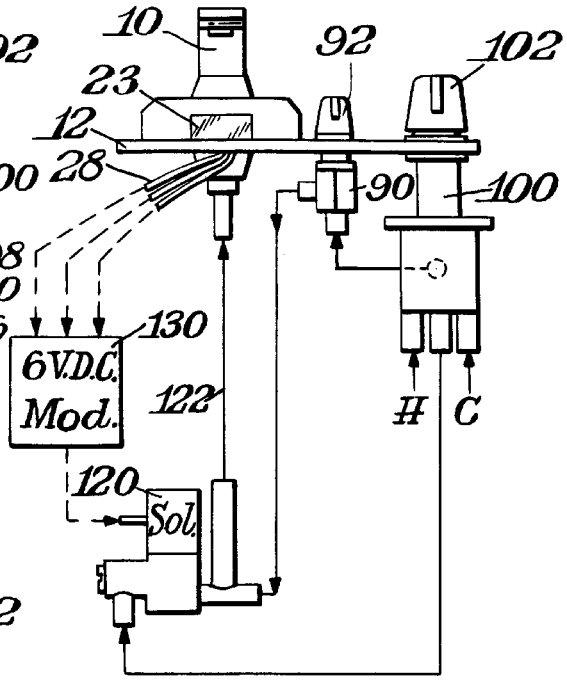
FIG. 8 is a schematic of another embodiment of the faucet assembly of this invention utilizing a sensor and bypass valve to electrically and manually control flow through the faucet.
Figure 9:
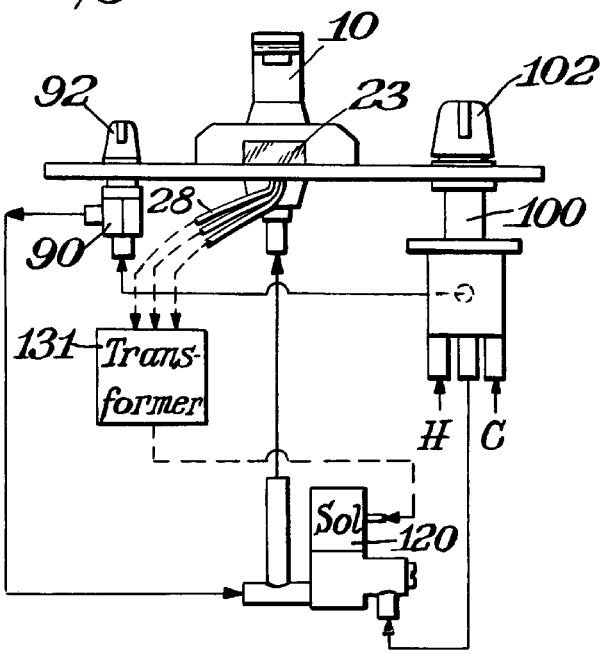
FIG. 9 is a schematic of another embodiment of a sensor operated faucet assembly utilizing a different configuration of visible components, i.e., faucet, manual bypass temperature control handles and transformer.

The overall operation of the faucet assembly is illustrated in FIGS. 7–9 and operates as described above. More particularly, the faucet assembly of this invention includes a temperature control valve 100 with hot and cold water inlets 104, 106 and outlets 108 and 110. This valve 100 controls the temperature of water exiting the faucet 10 by mixing hot and cold water from inlets 104 and 106.

The tempered water normally exits mixing valve 100 via outlet 108 and is conveyed by pipe or tubing 112 to an electronically operated solenoid valve 120 which controls flow of the tempered water to and through faucet 10 via tubing 122 in response to signals from push buttons or sensors associated therewith. Bypass valve 90 provides and alternate flow path via faucet outlets 108 or 110 and tubing 113, 118 for tempered water exiting mixing valve 100 as previously described.

As previously mentioned, water flow through faucet 10 may be initiated by a push-button illustrated in FIGS. 1–2 and 7 or by a sensor as illustrated in FIGS. 8 and 9. One or more control lines 28 emanating from the faucet 10 convey the push-button or sensor signal to low voltage powered operating module 130 which operated the solenoid valve 120. The operating module 130 receives the push button or sensor signal from faucet 10 and processes that signal in accordance with a known techniques to operate solenoid valve 120. The module 130 typically has a battery power source connected thereto, preferably a 6 volt lithium battery, to provide the power needed to operate the solenoid valve 120. Alternatively a transformer 131 may be used to supply low voltage operating power. One of the control lines 28 between the faucet 10 and module 130 can be used to light the battery status light 24 on the underside of the faucet 10 when the battery starts to run down.

The control module 130 can be programmed in a conventional manner, for example, via an application specific integrated circuit (ASIC) to operate solenoid valve 120 in response to signals from faucet 10. Accordingly, the ASIC can be programmed to open solenoid valve 120 and corresponding flow through faucet 10 in response to a user's initial application of pressure to the push button 22 on valve 10. The ASIC can be programmed to keep the solenoid open for a given period of time (10–20 seconds) before shutting off or to allow flow until the push button 22 is pushed again. Operational sequences can similarly be programmed for sensor operation, for example, initiating and continuing flow through the faucet so long as the sensor 23 senses the presence of a faucet user.

As previously noted, the solenoid valve 120 preferably utilizes a diaphragmatic valve whose on-off operation is controlled by solenoid actuation of a bleed line across the diaphragm. This type of valve minimizes power drain on the battery. Such valves are disclosed in U.S. Pat. Nos. 4,611,356, 4,886,207, 4,953,236 and 4,948,090, whose disclosures are incorporated herein by reference.

In the preferred embodiment of this invention the water flowing through the faucet is tempered by mixing water from hot 104 and cold 106 water supplies in a temperature control valve 100. Preferably this valve is mounted so that operation thereof can be accomplished by the user of the faucet, for example, as illustrated in FIGS. 7–9. As shown in these Figures the desired temperature of water is selected by the user with a simple rotation of the valve handle 102. Alternatively, where vandalism is prevalent or where varying water temperature selection is not needed the temperature control valve can be mounted below the sink deck 12 out of view or access to users. In this alternative embodiment the temperature control valve 100 is set and left untouched except by maintenance personnel.

Figure 10:
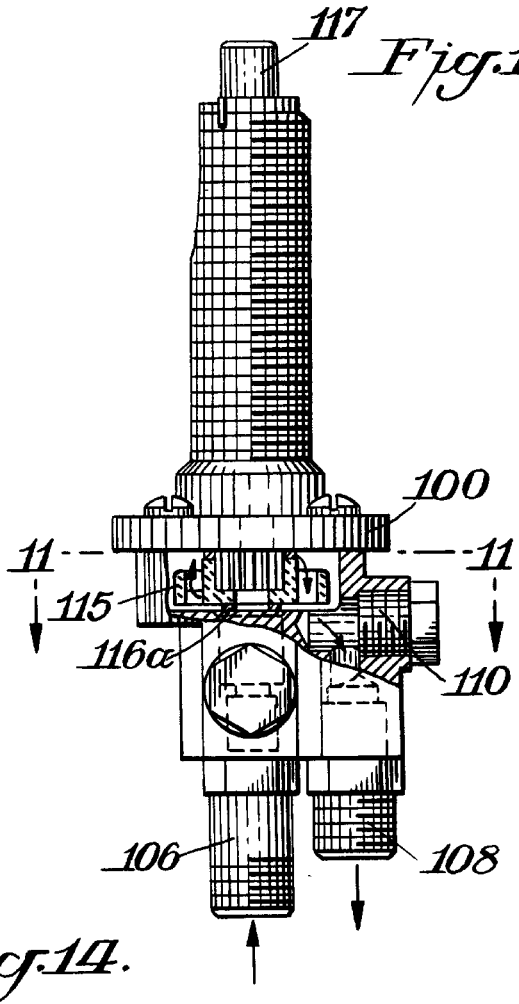
FIG. 10 is a view partially broken away in side elevation of the temperature control valve of the present invention.

Details of the temperature control valve 100 are illustrated in FIGS. 10–13. As illustrated this valve utilizes arcuate slots 114*a* and 114*b* in a movable ceramic disc element 115 passing over mating ceramic discs 116*a* and *b* in inlets 104 and 106. The use of a similar ceramic disc elements to control temperature of water in more fully described in U.S. Pat. No. 4,921,659 assigned to Speakman Company of Wilmington, Del., the disclosure of which is incorporated herein. As more fully described in that patent, rotation of the temperature control handle 102 rotates valve stem 117 which is keyed to ceramic disc 115. The varying width of the arcuate slots 114*a* and 114*b* in ceramic disc 115 sliding over inlet ceramic discs 116*a* and 116*b* throttle or increase the flow from the inlet ports to regulate water temperature as taught in U.S. Pat. No. 3,921,659. The flow path through inlets 104 and 106, the ceramic valve elements 115, 116 and existing through outlet 108 is illustrated in FIG. 10. Alternative hot and cold inlets 105 and 107, respectively, are illustrated in FIGS. 10–13. As illustrated, these inlets are capped, but available if the particular application makes it easier to pipe water to the temperature control valve 100 through these alternative inlets. Alternative outlet port 110 is provided as an outlet to bypass valve 90 as previously explained. Check valves 140 in inlet ports 104 and 106 are needed to prevent cross bleed between hot and cold water.

As previously mentioned, use of check valves creates a problem with operation of the solenoid valve 120 that applicant has solved. More particularly, a check valve 140 in the inlets 104 and 106 is designed to prevent back flow into inlet lines under normal circumstances. In doing so, however, the check valve 140 and the associated O-ring 141 would prevent release of pressure buildup on the upstream side 142 of check valve 140 caused by water hammer or other high pressure conditions in the inlet, were it not for applicant's invention. Applicant discovered that this pressure buildup above the check valve was the cause of random failure of solenoid valve operation. Applicant deduced that the failed operation of the solenoid valve was caused by the high pressure acting on one side of the solenoid valve diaphragm.

Figure 15:
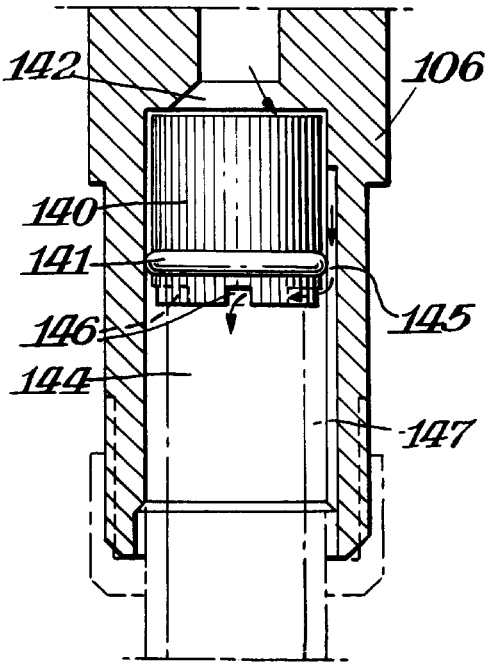
FIG. 15 is an enlarged elevational view in cross section showing the pressure release means of the present invention.
Figure 12:
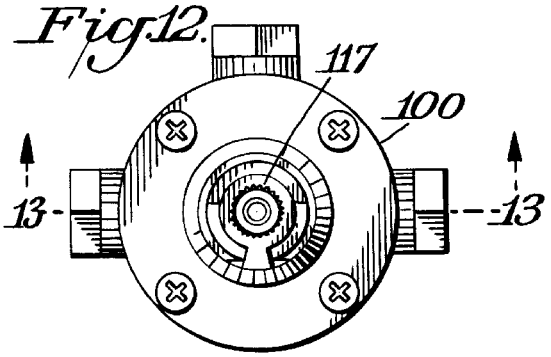
FIG. 12 is a top plan view of the temperature control valve of the present invention.
Figure 11:
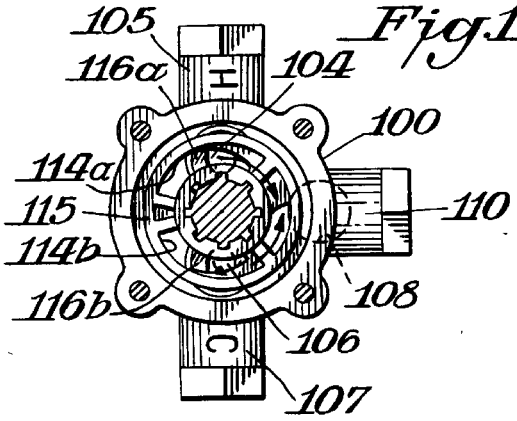
FIG. 11 is a cross sectional view of the temperature control valve taken along line 11—11 of FIG. 10.
Figure 13:
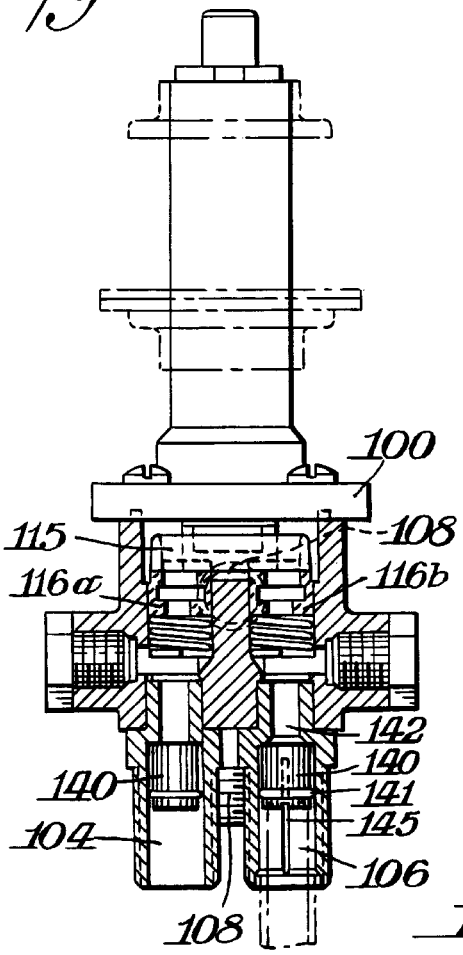
FIG. 13 is a cross sectional view of the temperature control valve taken along line 13—13 of FIG. 12.
Figure 14:
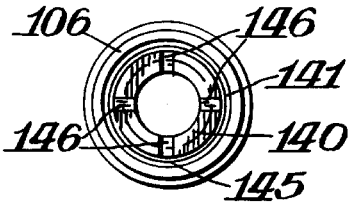
FIG. 14 is a bottom plan view of the cold water inlet of the temperature control valve showing grooves in the internal surface thereof.

A means to relieve this pressure buildup without altering the function of the check valve, i.e., prevent cross bleed, therefore had to be developed. That means is a small V-shaped groove 145 in the inside of one of the inlets 104 or 106, preferable the cold water inlet 106, as illustrated in FIG. 15. This groove 145 in cold water inlet 106 provides a means for bleeding off excess pressure in the area 142 above the check valve 140 while minimizing the chance of cross bleed of hot water around the check valve 140 into the cold water supply line. Typical dimensions of this V-shaped groove in a ⅜" diameter inlet are approximately 0.010 to 0.015 inch wide and 0.015 deep at the bottom of the V. The angle of the groove is preferably 30°–45°. The groove extends lengthwise along the internal diameter of the inlet from a point above the O-ring 141 to at least a point at the bottom of check valve 140 where cutouts 146 in the bottom edge of the check valve 140 relieve the pressure transmitted through the groove 145 into the inlet piping 147 (see FIGS. 14 and 15).

As previously mentioned, bypass valve 90 can be optionally provided as a safeguard against solenoid failure. A ceramic valve suitable for use as bypass valve 90 is disclosed and described in U.S. Pat. No. 4,651,770 assigned to Speakman Company, Wilmington, Del.

Having described the invention as in the foregoing, we claim:

1. An electrically operated faucet assembly comprising a faucet, a solenoid operated valve for controlling flow of fluid through the faucet and in fluid connection therewith, a temperature control valve with an outlet thereof connected to the supply side of the solenoid valve, check valves in the hot and cold water inlets of the temperature control valve and a longitudinal notch in the inside of at least one of the inlets extending from a point above the check valve to a point below the check valve whereby excess fluid pressure buildup between the check valve and solenoid valve is relieved through the longitudinal notch.

2. The electrically operated faucet assembly of claim 1 wherein the notch in the temperature control valve inlet is V-shaped.

3. The electrically operated faucet assembly of claim 1 wherein a bypass valve is arranged in a fluid connection path between an outlet of the temperature control valve and the faucet whereby the solenoid valve can be bypassed.

4. The electrically operated faucet assembly of claim 1 wherein a battery is used to power electrical operation of the faucet assembly.

5. The electrically operated faucet assembly of claim 2 wherein a low voltage transformer is used to supply power for the electrical operation of the faucet assembly.

* * * * *